United States Patent [19]

Turner

[11] 4,018,703

[45] Apr. 19, 1977

[54] CORROSION INHIBITORS

[75] Inventor: Mervyn Edward Dennant Turner, Billingham, England

[73] Assignee: Imperial Chemical Industries Limited, London, England

[22] Filed: Sept. 29, 1975

[21] Appl. No.: 617,528

[30] Foreign Application Priority Data

Oct. 14, 1974 United Kingdom ..... 44394/74

[52] U.S. Cl. ..... 252/394; 21/2.7 R

[51] Int. Cl.[2] ..... C23F 11/00; C23F 15/00

[58] Field of Search ..... 252/390, 393, 394; 21/2.7 R

[56] References Cited

UNITED STATES PATENTS

| | | | |
|---|---|---|---|
| 2,630,380 | 3/1953 | Hanson | 252/393 |
| 2,717,196 | 9/1955 | Wachter | 252/393 |
| 3,200,078 | 8/1965 | Braunwarth | 252/394 |
| 3,281,278 | 10/1966 | Schaefer | 252/393 |
| 3,294,501 | 12/1966 | Kawahara | 252/394 |
| 3,896,044 | 7/1975 | Mago | 21/2.7 R |

*Primary Examiner*—Samuel W. Engle
*Assistant Examiner*—Donald P. Walsh
*Attorney, Agent, or Firm*—Cushman, Darby & Cushman

[57] ABSTRACT

Inhibition of corrosion of steel, especially stainless steel in acid media, using a nitro-aromatic compound which contains a benzene ring substituted by at least one carboxyl substituent, for example dinitrosalicylic acid.

7 Claims, No Drawings

CORROSION INHIBITORS

The present invention relates to the inhibition of corrosion of steels.

Steel is the generic name for a group of ferrous metals, composed principally of iron, which have considerable durability and versatility. By the proper choice of carbon content and addition of alloying elements, and by suitable heat treatment, different kinds of steel can be made for various purposes and the use in industry of all kinds of steel is now very expensive.

One of the problems which arises in the use of steel is its corrosion, either by the atmosphere or by the environment in which it is used. The rate of corrosion may vary, depending on the surrounding conditions and also the composition of the steel. Stainless steel, especially, is much more resistant to corrosion than plain carbon and other steels. This resistance is due to the addition of chromium to alloys of iron and carbon. Other metals, for example copper, aluminium, also increase corrosion resistance but they are limited in their usefulness. Although stainless steel has appreciable resistance to corrosion, it will still corrode in certain circumstances and attempts have been made to prevent or reduce ths corrosion. For example, in acid media copper sulphate has been used as a corrosion inhibitor. However this and other proposed inhibitors are not entirely satisfactory since, like copper sulphate, they may be expensive, introduce an effluent disposal problem and, moreover, are not entirely effective.

According to the present invention, a method of inhibiting the corrosion of a steel comprises maintaining in the medium which is in contact with the steel a minor amount of a nitro-aromatic compound which contains a benzene ring substituted by at least one carboxyl substituent.

By a minor concentration of nitro-aromatic compound, we mean, for example, an amount between 100 p.p.m. and 2% by weight based on the weight of the medium which is in contact with the steel. Preferably the amount of nitro-aromatic compound lies in the range 100 p.p.m. to 0.1% by weight.

We have found that in general dinitro-aromatic compounds are more effective in the method of the invention than mononitro-aromatic compounds. Particularly preferred compounds are dinitrosalicyclic acid, nitrophthalic acid and mono- and di-nitroterephthalic acids.

The nitro-aromatic compound may be added per se, or in suspension or in solution to the medium in contact with the steel.

We have found that the method of the invention is very useful in inhibiting corrosion of stainless steel in an acidic medium, whether aqueous or non-aqueous, especially one which comprises sulphuric acid or oleum. If the acidic medium is oleum or strong sulphuric acid it is convenient to generate the nitroaromatic compound in situ, a convenient method of doing this being to add nitric acid to the corresponding aromatic acid in the sulphuric acid or oleum medium. Although the method of the invention is believed to be less effective in other acid media its applicability to them is not excluded from th scope of this invention.

One embodiment of the invention will not be described by way of Example.

EXAMPLE

The corrosion of several specimens of stainless steel in a sulphuric acid medium was tested in the presence and absence of dinitrosalicyclic acid. The specimens were sections of ¾ inch outside diameter, 16 g tube of Type 321 stainless steel, each fitted with an internal electric heater. The acidic solution under test was made by mixing 27 g. of 9% sulphuric acid with 250 g. water, this mixture being made up to 1 liter with methanol. For the test, appropriate weighed amounts of dinitrosalicyclic acid were dissolved in this solution and the solution was then transferred to a glass vessel consisting of two vertical tubes connected top and bottom to each other. The test specimen was immersed in one of the tubes and a cooler was fitted in the other tube. The heat input to the specimen from its electric heater and the water coolant flow to the cooler were adjusted so as to maintain a bulk fluid temperature of 72° C with continuous nucleate boiling on the surface of the specimen.

Before each test, the specimen under test was either "passivated" by immersion in 20% nitric acid or "activated" by immersion in 20% hydrochloric acid, washed in distilled water and immediately transferred to the test solution.

Each test lasted 24 hours. After the tests, each solution was analysed for iron, nickel and chromium. The following Table illustrates the results obtained.

| Test No. | Inhibitor Concentration grms/liter | Initial Specimen State | ppm metal in test solution | | |
|---|---|---|---|---|---|
| | | | Iron | Nickel | Chromium |
| 1 | 0 | passive | 800 | 160 | 230 |
| 2 | 0.2 | passive | 0.6 | 0.2 | 0.1 |
| 3 | 0.3 | active | 590 | 72 | 170 |
| 4 | 0.6 | active | 94 | 13 | 28 |
| 5 | 1.0 | active | 0.35 | 0.2 | 0.1 |
| 6 | 0.7 | active | 800 | 110 | 240 |
| 7 | 0.9 | active | 0.6 | 0.2 | 0.1 |

The results in the Table clearly show the improvement brought about by the presence of dinitrosalicylic acid. With a passive specimen, only 0.2 g/liter of dinitrosalicyclic acid is required to inhibit corrosion and maintain passivity. In the case of an active specimen, a concentration of about 0.9 g/liter effectively inhibits corrosion.

I claim:

1. A method of inhibiting the corrosion of steel which in use is contacted with a sulphuric acid or oleum medium which corrodes said steel which comprises maintaining in the medium contacting said steel an amount of a compound selected from the group consisting of dinitrosalicylic acid, nitrophthalic acid, monitroterephthalic acid and dinitroterephthalic acid effective to inhibit corrosion of the steel.

2. A method as claimed in claim 1 in which the amount of said compound is in the range 100 p.p.m. to 2% by weight based on the weight of the medium which is in contact with the steel.

3. A method as claimed in claim 1 in which the amount of said compound is in the range 100 p.p.m. to 0.1% by weight based on the weight of the medium which is in contact with the steel.

4. A method as claimed in claim 2 in which the said compound is added to the medium in contact with the steel.

5. A method as claimed in claim 1 in which the said compound is generated in situ in the acidic medium.

6. A method as claimed in claim 5, wherein nitric acid and an aromatic acid are added to the medium to produce said compound.

7. A method as claimed in claim 1, wherein said compound is dinitrosalicylic acid.

* * * * *